United States Patent [19]

Iwakura et al.

[11] Patent Number: 4,994,431

[45] Date of Patent: Feb. 19, 1991

[54] HEAT-SENSITIVE RECORDING MATERIAL

[75] Inventors: Ken Iwakura; Naoto Yanagihara; Masato Satomura; Takayuki Hayashi, all of Shizuoka, Japan

[73] Assignee: Fuji Photo Film Co., Ltd., Kanagawa, Japan

[21] Appl. No.: 401,899

[22] Filed: Sep. 1, 1989

[30] Foreign Application Priority Data

Sep. 2, 1989 [JP] Japan ..... 63-220190
Sep. 6, 1989 [JP] Japan ..... 63-22651

[51] Int. Cl.[5] ..... B41M 5/18
[52] U.S. Cl. ..... 503/208; 503/209; 503/225
[58] Field of Search ..... 427/150–152; 503/208, 209, 225

[56] References Cited

U.S. PATENT DOCUMENTS 4,531,140 7/1985 Suzuki et al. ..... 503/208
4,833,121 5/1989 Ikeda et al. ..... 503/209
4,855,278 8/1989 Igarashi et al. ..... 503/208

*Primary Examiner*—Bruce H. Hess
*Attorney, Agent, or Firm*—Sughrue, Mion, Zinn, Macpeak & Seas

[57] ABSTRACT

A heat-sensitive recording material comprising a support having provided thereon a heat-sensitive color forming layer containing a colorless or slightly colored electron donating dye precursor and an electron accepting compound capable of forming color by the reaction with the electron donating dye precursor, wherein the heat-sensitive color forming layer contains a 1-alkoxyphenoxy-2-aryloxypropane. The recording material exhibits high sensitivity and satisfactory preservation stability.

7 Claims, No Drawings

HEAT-SENSITIVE RECORDING MATERIAL

FIELD OF THE INVENTION

This invention relates to a heat-sensitive recording material and, more particularly, to a heat-sensitive material comprising a support having provided thereon a color forming layer containing a colorless or slightly colored electron donating dye precursor (hereinafter referred to as a color former) and an electron accepting compound (hereinafter referred to as a color developer).

BACKGROUND OF THE INVENTION

So far proposed heat-sensitive recording systems include a wide variety of embodiments. For example, heat-sensitive recording materials using a color former and a color developer are disclosed in U.S. Pat. Nos. 4,255,491, and JP-B-43-4160 and JP-B-45-14039 (the term "JP-B" as used herein means an "examined published Japanese patent application"). With the recent tendencies to rapids reduced energy heat-sensitive recording systems, extensive studies have been directed to an increase of sensitivity of heat-sensitive recording materials. In this connection, many attempts have been made to increase sensitivity by utilizing various additives or sensitizers, and the inventors of the present invention have filed patent applications on several such compounds [e.g., JP-A-58-57989 (corresponding to U.S. Pat. No. 4,480,052), JP-A-58-87044 (corresponding to U.S. Pat. No. 4,471,074), and JP-A-61-123581 (the term "JP-A" as used herein means an "unexamined published Japanese patent application")].

On the other hand, there is a tendency that the temperature at which color formation of a heat-sensitive recording material initiates decreases as the sensitivity of a recording material increases. This tendency not only leads to undesired color formation on white background after black image formation with facsimiles, etc. but also gives rise to a problem relating to preservability at high temperatures. It has been therefore desirable to develop a heat-sensitive recording material exhibiting high sensitivity while retaining satisfactory preservation stability.

SUMMARY OF THE INVENTION

One object of this invention is to provide a heat-sensitive recording material exhibiting high sensitivity and satisfactory preservation stability.

It has now been found that the above object of this invention can be accomplished by using a 1-alkoxyphenoxy-2-aryloxypropane as a sensitizer in a heat-sensitive recording material comprising a support having provided thereon a heat-sensitive color forming layer containing a color former and a color developer as main components.

DETAILED DESCRIPTION OF THE INVENTION

In the 1-alkoxyphenoxy-2-aryloxypropane according to the present invention, the term "aryl" means a phenyl group which may be substituted with an alkyl group, a halogen atom, an alkoxy group, or alkylthio group. The alkyl, alkoxyl or alkylthio group as a substituent for the phenyl group preferably contains from 1 to 4 carbon atoms, and the halogen atom preferably includes a chlorine atom and a fluorine atom. The 1-alkoxyl group preferably contains from 1 to 4 carbon atoms.

Preferred of the 1-alkoxyphenoxy-2-aryloxypropanes of the invention are those represented by formula (I):

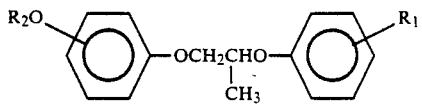

(I)

wherein $R_1$ represents a hydrogen atom, an alkyl group, an alkoxyl group or a halogen atom; and $R_2$ represents an alkyl group.

In formula (I), the alkyl group as represented by $R_1$ or $R_2$ or the alkoxyl group as represented by $R_1$ preferably obtains from 1 to 4 carbon atoms, and the $R_2O$— moiety is preferably at the p-position. Particularly preferred of them are those having a melting point of not less than 78° C.

Specific examples of the 1-alkoxyphenoxy-2-aryloxypropane are 1,2-bis(4-methoxyphenoxy)propane, 1,2-bis(4-ethoxyphenoxy)propane, 1-(4-methoxyphenoxy)-2-(4-ethoxyphenoxy)propane 1-(4-ethoxyphenoxy)-2-(4-methoxyphenyoxy)propane, 1,2-bis(2-methoxyphenoxy)propane, 1- (4-methoxyphenoxy)-2-(2-methoxyphenoxy)propane, 1-(4- methoxyphenoxy)-2-phenoxypropane, 1-(4-methoxyphenoxy)- 2-(4-ethylphenoxy)-propane, 1-(4-methoxyphenoxy)-2-(4methylthiophenoxy) 1-(4-methoxyphenoxy)-2-(4chlorophenoxy)-propane, and 1-(4-ethoxyphenoxy)-2phenoxypropane, preferably 1,2-bis(4-methoxyphenoxy)-propane, 1,2-bis(2-methoxyphenoxy)propane, 1-(4- methoxyphenoxy)-2-(2-methoxyphenoxy)propane or 1-(4- methoxyphenoxy)-2-phenoxypropane, more preferably 1,2bis(4-methoxyphenoxy)propane or 1-(4-methoxyphenoxy)-2phenoxypropane.

The compound (I) have high color formation initiation temperatures and specifically high sensitivity.

The 1-alkoxyphenoxy-2-aryloxypropane according to the present invention is usually used in an amount of 10% by weight or more, preferably from 50 to 300% by weight, based on the color former.

The compounds according to the present invention can be synthesized by various processes. In the most simple and convenient process, a halogenated compound or a reactive ester (e.g., arylsulfonic acid esters) of the corresponding alkoxyphenoxypropanol, or a ditosylate of a 1,2-dihydroxypropane or a 1,2-dihalopropane is reacted with a phenol derivative in the presence of a basic catalyst with or without a polar solvent. The basic catalyst is generally selected from alkali metal compounds, preferably including sodium compounds and potassium compounds.

The color former which can be used in the present invention includes various dyes known in the field of heat-sensitive paper and pressure-sensitive copying paper.

Examples of usable color formers include triphenylmethane phthalide compounds, fluoran compounds, phenothiazine compounds, rhodamine lactam compounds, indolylphthalide compounds, leucoauramine compounds, triphenyl compounds, triazene compounds, and spiropyran compounds.

Specific examples of the known phthalide compounds are described, e.g., in U.S. Reissue Pat. 23,024, and U.S. Pat. Nos. 3,491,111, 3,491,112, 3,491,116, and 3,509,174. Specific examples of the known fluoran compounds are described, e.g., in U.S. Pat. Nos. 3,624,107, 3,920,510, and 3,959,571. Specific examples of the known spiropyran compounds are described, e.g., in U.S. Pat. No. 3,971,818. Specific examples of pyridine and pyrazine compounds are described, e.g., in U.S. Pat. Nos. 3,775,424, 3,853,869, and 4,246,318.

Particularly effective among them are 2-arylamino-3-H (or halogn atom, alkyl, or alkoxy)-6substituted aminofluoran compounds which develop a black color on reaction with color developers.

Illustrative examples of these color formers are given below.

Triarylmethane compounds include 3,3-bis(p-dimethylaminophenyl)-6-dimethylaminophthalide (i.e., Crystal Violet Lactone), 3,3-bis(p-dimethylaminophenyl)phthalide, 3-(p-dimethylaminophenyl)-3-(1,3-dimethyl-indol-3-yl)phthalide, and 3-(p-dimethylaminophenyl) -3- (2-methylindol-3-yl)phthalide. Diphenylmethane compounds include 4,4'-bisdimethylaminobenzhydrin benzyl ether, an N-halophenylleucoauramine, and N-2,4,5trichlorophenylleucoauramine. X-anthene compounds include rhodamine B anilinolactam rhodamine (p-nitrinolactam), 3-diethylamino-7,8-benzofluoran, rhodamine B (p-chloroanilino)lactam, 2-anilino-3-methyl-6-N-ethyl-N-dodecylaminofluoran, 2 anilino-3-methyl-6-N-methyl-N-isopropylaminofluoran, 2-anilino-3-methyl-6-N-methyl-N-pentylaminofluoran, 2-anilino-3-methyl-6-N-methyl-N-cyclohexylaminofluoran, 2-anilino-3-methyl-6-diethyl-aminofluoran, 2-anilino-3-methyl 6-dibutylaminofluoran, 2-anilino-3-methyl-6-N-methyl-N-furfurylaminofluoran, 2-anilino-3-methyl-6-N-ethyl-N-isoamylaminofluoran, 2-anilino-3-methyl-6-N-methyl-N-isoamylaminofluoran, 2-anilino-3-chloro-6-diethylaminofluoran, 2-anilino-3-chloro-6-N-cyclohexyl-N-dodecylaminofluoran, 2-(2,4-di-methylanilino)-3-methyl-6-diethylaminofluoran, 2-(p-methylanilino)-3-methyl-6-N-methyl-N-ethylaminofluoran, and 2-anilino-3-ethyl-6-N-ethyl-N-furylmethylamino-fluoran. Indolylphthalide compounds include 3,3-bis(1-methylindol-3-yl)phthalide, 3-(2-ethoxy 4-diethylamino-phenyl)-3-(1-ethyl-2-methylindol-3-yl)phthalide, 3-(2-ethoxy-4-dibutylaminophenyl)-3-(1-ethyl-2-methylindol-3yl)phthalide, 3-(2-amyloxy-4-diethylaminophenyl)-3-(1-ethyl-2-methylindol-3 yl)phthalide, and 3-(2-ethoxy-4-diethylaminophenyl)-3-(1-octyl-2-methylindol-3-yl)phthalide. Pyridine compounds include 3-(2-ethoxy-4-diethylaminophenyl)-3-(1-octyl-2-methylindol-3-yl)-4- or -7-azaphthalide, 3-(2-ethoxy-4-diethylaminophenyl)-3-(1-ethyl-2-methylindol-3-yl)-4- or -7-azaphthalide, 3-(2- hexyloxy-4-diethylaminophenyl)-3-(1-ethyl-2-methylindol3-yl)-4or -7-azaphthalide, 3-(2-ethoxy-4-diethylaminophenyl) 3-(1-ethyl-2-phenylindol-3-yl)-4- or -7-azaphthalide, 3-(2-butoxy-4-diethylaminophenyl)-3-(1-ethyl-2-phenylindol-3-yl)-4- or -7-azaphthalide, and 3(2-ethoxy-4-diethylaminophenyl) -3-(1-octyl-2-phenyl-indol-3-yl)-4- or -7-azaphthalide. Fluorene compounds include 3,6-bisdiethylamino-5-diethylaminospiro(isobenzofuran-1,9-fluoren)-3-one, 3,6-bisdimethylamino-7-diethyltylamino-2-methyl-spiro(1,3-benzoxazine-4,9-fluorene)-3-one, and 3,6-bis-diethylamino-7-diethyl-aminospiro(2-hydro-1,3-benzoxazine-4,9-fluorene)-2-one. These color formers may be used either individually or in combination of two or more thereof. From the standpoint of back color formation, the fluoran compounds are particularly preferred.

The color developer which can be preferably used in the present invention include phenolic compounds and salicylic acid derivatives or polyvalent metal salts thereof. Illustrative examples of the phenolic compounds are 2,2'-bis(4-hydroxyphenyl)propane, 4-t-butylphenol, '4-phenylphenol, 4-hydroxydiphenoxide, 1,1'-bis (3-chloro-4-hydroxyphenyl)cyclohexane, 1,1'-bis(4hydroxy-phenyl)cyclohexane, 1,1'-bis(3-chloro-4-hydroxy- phenyl)-2-ethylbutane, 4,4'-sec-isooctylidenediphenol, 4,4'-sec-butylidenediphenol, 4-t-octylphenol, 4-p-methylphenylphenol, 4,4'-methylcyclohexylidenephenol, 4,4'-isopentylidenediphenol, and benzyl p-hydroxybenzoate. Illustrative examples of the salicylic acid derivatives are 4-pentadecylsalicylic acid, 3,5-di(α-methylbenzyl)salicylic acid, 3,5-di(t-octyl)salicylic acid, 5-octadecylsalicylic acid, 5-α-(p-α-methylbenzylphenyl)ethylsalicylic acid, 3-α-methylbenzyl-5-t-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, and 4-octadecyloxysalicylic acid; and zinc, aluminum, calcium, copper or lead salts of these salicylic acids.

The color developer is preferably used in an amount of from 50 to 800% by weight, more preferably from 100 to 500% by weight, based on the color former. If the amount of the color developer is less than 50%, color formation would be insufficient. Addition of more than 800% brings about no further improvement.

The 1-alkoxyphenoxy-2-aryloxypropane according to the present invention can be used in combination with other sensitizers, such as the compounds disclosed hereinafter. Examples of such compounds include aromatic ethers or esters and aliphatic amides or ureides.

Examples of the aromatic ethers or esters are benzyloxynaphthalene, di-m-tolyloxyethane, β-phenoxyethoxyanisole, 1-phenoxy-2-p-ethylphenoxyethane, bis(p-methoxyphenoxy)ethoxymethane, bis-β-p-methoxyphenoxy)-tolyloxy-2-p-methylphenoxyethane, 1,2-diphenoxyethane, 1,4-diphenoxybutane, bis-β-(p-ethoxyphenoxy)ethyl ether, 1-phenoxy-2-p-chlorophenoxyethane, 1-p-methylphenoxy-2-p'-fluorophenoxyethane, 1,2-bis-p-methoxyphenylthioethoxyethane, 1-phenoxy-2-p-methoxyphenylthioethyl ether, 1,2-bis-p-methoxyphenylthioethane, 1-tolyloxy-2-p-methoxyphenylthioethane, β-naphthyl-p-methylphenoxy-acetate, β-naphthyl-p-methoxyphenoxyacetate, p-methoxy-phenyl-p'-methoxyphenoxyacetate, β-phenoxyethyl-naphth-yl-(2)-oxyacetate, β-p-chlorophenoxyethyl-naphthyl-(2)'oxyacetate, β-p-methylphenoxyethyl-naphthyl-(2)-oxyacetate, β-naphthyl-(2)-oxyethylbenzyl carbonate, di-tolyl carbonate, 4-ethoxy-1-methoxynaphthalene, 1-hydroxy-2-naphthoic acid phenyl ester, 1-benz-yloxybenzoic acid benzyl ester, phenyl benzoate, bis-β-p-methoxyphenoxyethyl carbonate, β-phenoxyethoxybenzoic acid butylamide, β-naphthylthiobenzyl ether, ethylene glycol-(2)-oxyacetate, 1,4-butanediol-bis-naphthoxyacetate, benzyl 2-butoxy-6-naphthoate, 4-allyloxybiphenyl, and 1-naphthyl-(2)-oxy-2-phenoxypropane.

Examples of the amide compounds which are particularly effective include stearamide, methylenebisstearamide, stearylurea, cyclohexylurea, stearic acid anisizide, benzoylstearylamine, phenoxyacetobenzylamide, phenylacetylbenzylamide, butoxyethylbenzylamide, and furic benzylamide.

The heat-sensitive recording material according to the present invention can be produced in the manner as described, for example, in U.S. Pat. 4,255,491. In the preparation of a typical heat-sensitive color forming layer according to the present invention, each of a color former, a color developer, and a sensitizer is usually dispersed in a ball mill, a sand mill, etc. together with a water-soluble high-molecular binder, e.g., polyvinyl alcohol, to particles of several microns or smaller. The sensitizer may be added to either the color former or the color developer or both and dispersed simultaneously. If necessary, an eutectic mixture may be previously prepared and then dispersed.

These dispersions are mixed together and, if desired, mixed with pigments, surface active agents, other binders, metallic soaps, waxes, antioxidants, ultraviolet absorbents, etc. to prepare a heat-sensitive coating composition. The composition is coated on a support, such as fine paper, fine paper having a subbing layer, synthetic paper, and plastic films, and smoothened by calendering.

The binder which can be used in the present invention preferably includes compounds having solubility of at least 5% by weight in water at 25° C. Examples of such compounds are polyvinyl alcohol (inclusive of modified ones, e.g., carboxyl-, itaconic acid-, maleic acid- or silica-modified polyvinyl alcohol), methyl cellulose, carboxymethyl cellulose, starches (inclusive of modified starches), gelatin, gum arabic, casein, styrene-maleic anhydride copolymer hydrolysis products, polyacrylamide, and vinyl acetateacrylic acid copolymer saponification products. The binder is used not only for dispersion but also for improvement of film strength. For ensuring the latter effect, latices of synthetic high polymers, e.g., styrene-butadiene copolymers, vinyl acetate copolymers, acrylonitrile-butadiene copolymers, methyl acrylatebutadiene copolymers, and polyvinylidene chloride, may be used in combination. If desired, an appropriate crosslinking agent for the binder may be added according to the kind of the binder.

The pigments to be added include calcium carbonate, barium sulfate, lithopone, agalmatolite, kaolin, silica, and amorphous silica.

The metallic soaps to be added includes higher fatty acid metal salts, e.g., zinc stearate, calcium stearate, and aluminum stearate.

The waxes to be used include paraffin wax, microcrystalline wax, carnauba wax, methylolstearamide, polyethylene wax, polystyrene wax, fatty acid amide type waxes, and mixtures thereof.

If desired, the color forming layer may further contain surface active agents, antistatics, ultraviolet absorbents, antioxidants, defoaming agents, conductivity-imparting agents, fluorescent dyes, and coloring dyes.

In order to prevent discoloration of an image area and to make the image fast, it is preferable to add a discoloration inhibitor to the color forming layer. The discoloration inhibitor to be used includes phenol compounds, and particularly hindered phenol compounds. Examples of the hindered phenol compounds are 1,1,3-tris(2-methyl-4-hydroxy-t-butylphenyl)butane, 1,1,3-tris(2-ethyl-4-hydroxy-5-t-butylphenyl)butane, 1,1,3tris(3,5-di-t-butyl-4-hydroxyphenyl)butane, 1,1,3-tris-(2-methyl-4-hydroxy-5-t-butylphenyl)propane, 2,2'methylenebis(6-t-butyl-4-methylphenol), 2,2'-methylenebis(6-t-butyl-4-ethylphenol), 4,4'-butylidenebis(6-t-butyl-3-methylphenol), and 4,4'-thiobis(3-methyl-6-t- (butylphenol). The phenol compound is preferably used in an amount of from 1 to 200% by weight, more preferably from 5 to 50% by weight, based on the color developer.

The coated material is dried and subjected to calendering to obtain a heat-sensitive recording material.

If desired, a protective layer may be provided on the heat-sensitive recording layer. The protective layer may have any composition known for a protective layer of a heat-sensitive recording material.

If desired, a back coat layer may be provided on the support of the heat-sensitive recording material on the side opposite to the heat-sensitive recording layer. Any of known back coat layers may be used.

The present invention is now illustrated in greater detail by way of the following Synthesis Examples and Examples, but it should be understood that the present invention is not deemed to be limited thereto. In these examples, all the percents are by weight unless otherwise indicated.

SYNTHESIS EXAMPLE 1

In 500 ml of acetonitrile were dissolved 168 g of 1-p-methoxyphenoxy-2-propanol and 62 g of p-methoxyphenol. To the solution was added 50 g of a 48% sodium hydroxide aqueous solution, and the mixture was allowed to react at 80° C for 3 hours while stirring. The reaction mixture was poured into water, and the precipitated crystals were collected by filtration and recrystallized from methanol to obtain 110 g of 1,2-bis(4-methoxyphenoxy)propane having a melting point of 84 to 84.5° C.

SYNTHESIS EXAMPLE 2

In the same manner as in Synthesis Example 1, the following compounds were obtained.

1,2-Bis(4-ethoxyphenoxy)propane (m.p.: 68.5°–69° C.),
1-(4-Methoxyphenoxy)-2-(4-ethoxyphenoxy)propane (m.p.: 64.5°–65° C.),
1-(4-Ethoxyphenoxy)-2-(4-methoxyphenoxy)propane (m.p.: 54.0°–55° C.),
1,2-Bis(2-methoxyphenoxy)propane (m.p.: 83.0°–84° C.),
1-(4-Methoxyphenoxy)-2-(2-methoxyphenoxy)propane (m.p.: 80.5°–81° C.),
1-(4-Methoxyphenoxy)-2-phenoxypropane (m.p.: 87°–88° C.),
1-(4-Methoxyphenoxy)-2-(4-ethylphenoxy)propane (m.p.: 42°–43° C.), 1-(4-Ethoxyphenoxy)-2-(4-ethylphenoxy)propane (m.p.: 45°–46° C.), and
1-(4-Ethoxyphenoxy)-2-(4-fluorophenoxy)propane (m.p.: 58°–59° C.)

EXAMPLE 1

Twenty grams each of 2-anilino-3-methyl-6-N-ethyl-N-isoamylaminofluoran as a color former, bisphenol A as a color developer, and 1,2-bis(4-methoxyphenoxy) propane as a sensitizer were separately dispersed in 100 g of a 5% aqueous solution of polyvinyl alcohol "Kuraray PVA-105" (produced by Kuraray Co., Ltd.) in a ball mill for a whole day to prepare 3 dispersions having a 1.5 μm or smaller average particle size. Further, 80 g of calcium carbonate was dispersed in 160 g of a 0.5% aqueous solution of sodium hexametaphosphate in a homogenizer to prepare a pigment dispersion.

Five grams of the color former dispersion, 10 g of the color developer dispersion, 10 g of the sensitizer dispersion, and 15 g of the pigment dispersion were mixed, and 3 g of a 21% zinc stearate emulsion was added thereto to prepare a coating composition.

The composition was coated on fine paper with a coating bar to a dry coverage of 5 g/m$^2$ and dried at 50° C. for 1 minute to obtain heat-sensitive recording paper.

EXAMPLE 2

Heat-sensitive recording paper was prepared in the same manner as in Example 1, except for replacing 2-anilino-3-methyl-6-N-ethyl-N-isoamylaminofluoran with 2-anilino-3-methyl-6-dibutylaminofluoran.

EXAMPLE 3

Heat-sensitive recording paper was prepared in the same manner as in Example 1, except for replacing 2-anilino-3-methyl-6-N-ethyl-N-isoamylaminofluoran with 2-anilino-3-methyl-6-diethylaminofluoran.

EXAMPLE 4

Heat-sensitive recording paper was prepared in the same manner as in Example 1, except for replacing 1,2-bis(4-methoxyphenoxy)propane with 1-(4-methoxyphenoxy)-2-phenoxypropane.

COMPARATIVE EXAMPLE 1

Heat-sensitive recording paper was prepared in the same manner as in Example 1, except for replacing 1,2-bis(4-methyoxyphenoxy)propane with 1-phenoxy-2-βnaphthoxypropane.

Each of the heat-sensitive recording papers obtained in Examples 1 to 4 and Comparative Example 1 was subjected to calendering. Heat recording was carried out on the heat-sensitive recording paper by the use of a heat-sensitive printing testing machine containing a thermal head "KLT-216-βMPDI" (produced by Kyocera K.K.) and a pressure roll (100 kg cm$^2$) immediately in front of the head under conditions of 24 V in head voltage, 10 ms in pulse cycle, and 0.8, 1.0 or 1.2 in pulse width. The image density was measured with a Macbeth reflective densitometer ("RD-918"). Further, the heat-sensitive recording paper was allowed to stand at 60° C. and 30% RH for 24 hours, and the background fog was measured with RD-918. The results obtained are shown in Table 1.

TABLE 1

| | Color Density Pulse Width (ms) | | | Background |
|---|---|---|---|---|
| | 0.80 | 1.00 | 1.20 | Fog |
| Example 1 | 0.90 | 1.30 | 1.35 | 0.12 |
| Example 2 | 0.88 | 1.25 | 1.35 | 0.10 |
| Example 3 | 0.91 | 1.32 | 1.38 | 0.13 |
| Example 4 | 0.88 | 1.29 | 1.35 | 0.08 |
| Comparative | 0.75 | 1.15 | 1.25 | 0.20 |

TABLE 1-continued

| | Color Density Pulse Width (ms) | | | Background |
|---|---|---|---|---|
| | 0.80 | 1.00 | 1.20 | Fog |
| Example 1 | | | | |

As can be seen from Table 1, the heat-sensitive recording materials in accordance with the present invention provide color images of satisfactory density even with low energy and exhibit satisfactory resistance to background fog when preserved at a high temperature.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having provided thereon a heat-sensitive color forming layer containing a colorless or slightly colored electron donating dye precursor and an electron accepting compound capable of forming color by the reaction with said electron donating dye precursor, wherein the said heat-sensitive color forming layer contains a 1-alkoxyphenoxy-2-aryloxypropane compound represented by formula (I):

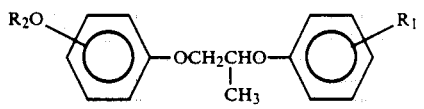

(I)

wherein $R_1$ represents a hydrogen atom, an alkyl group, an alkoxyl group or a halogen atom; and $R_2$ represents an alkyl group.

2. A heat-sensitive recording material as claimed in claim 1, wherien the aryl group in said 1-alkoxyphenoxy-2-aryloxypropane is a pehnyl group or a phenyl group substituted with an alkyl group, a halogen atom, an alkoxyl group, or an alkylthio group.

3. A heat-sensitive recording material as claimed in claim 1, wherein said alkyl group and alkoxyl group in formula (I) contains from 1 to 6 carbon atoms.

4. A heat-sensitive recording material as claimed in claim 1, wherein said compound has a melting point of 78° C. or higher.

5. A heat-sensitive recording material as claimed in claim 1, wherein said 1-alkoxyphenoxy-2-aryloxypropane is present in an amount of from 50 to 300% by weight based on the electron donating colorless dye.

6. A heat-sensitive recording material as claimed in claim 1, wherein said 1-alkoxyphenoxy-2-aryloxypropane is 1,2-bis(4-methoxyphenoxy)propane.

7. A heat-sensitive recording material as claimed in claim 1, wherein said 1-alkoxyphenoxy-2-aryloxypropane is 1-(4-methoxyphenoxy)-2-phenoxypropane.

* * * * *